United States Patent [19]

Sidler et al.

[11] Patent Number: 4,643,112

[45] Date of Patent: Feb. 17, 1987

[54] DEVICE FOR BRAKING THE LIMBS OF NEEDLE THREADS IN OSCILLATING HOOK TYPE SEWING MACHINES

[75] Inventors: Gregor Sidler; Jakob Rickenbach, both of Steckborn, Switzerland

[73] Assignee: Fritz Gegauf AG, Bernina-Nähmaschinenfabrik, Steckborn, Switzerland

[21] Appl. No.: 777,927

[22] Filed: Sep. 19, 1985

[30] Foreign Application Priority Data

Sep. 19, 1984 [CH] Switzerland ..... 4487/84

[51] Int. Cl.[4] ..... D05B 57/12

[52] U.S. Cl. ..... 112/185; 112/192; 112/232

[58] Field of Search ..... 112/164, 185, 187, 192, 112/232

[56] References Cited

U.S. PATENT DOCUMENTS 1,129,365 2/1915 Skinner ..... 112/232 X
1,162,697 11/1915 Jerram ..... 112/232 X

FOREIGN PATENT DOCUMENTS 7016286 8/1970 Fed. Rep. of Germany .
3342770 7/1984 Fed. Rep. of Germany .

*Primary Examiner*—Wm. Carter Reynolds
*Attorney, Agent, or Firm*—Peter K. Kontler

[57] ABSTRACT

One limb of each loop which is formed by the needle thread in an oscillating hook type sewing machine is temporarily in contact with the loop-engaging member of a braking device whose torsion spring is non-rotatably installed in the hollow mandrel of the hook. The loop-engaging member is turned by successive loops from a starting position, relative to the hook and against the opposition of the spring so that it tensions the loop while the latter is raised by the takeup lever. The spring thereupon rapidly returns the loop-engaging member to its starting position. The loop-engaging member is integral with a loop catcher which intercepts the loop when the latter is cast off the hook and which ensures that the loop comes in contact with the loop-engaging member.

17 Claims, 8 Drawing Figures

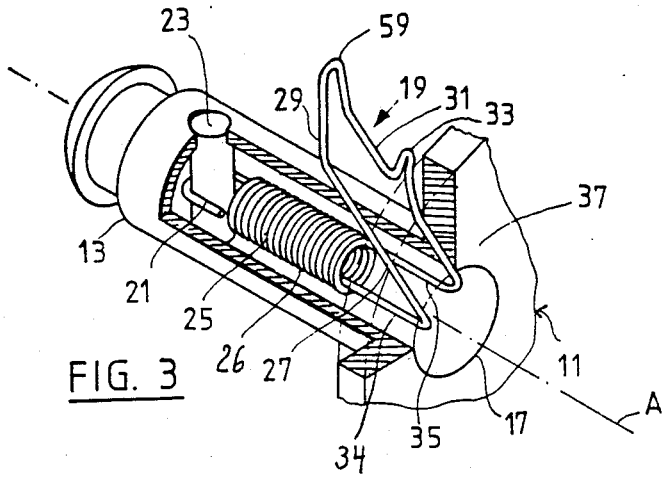
FIG. 3
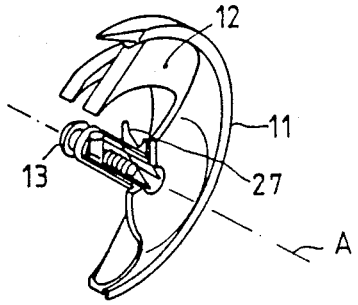
FIG. 2
FIG. 4
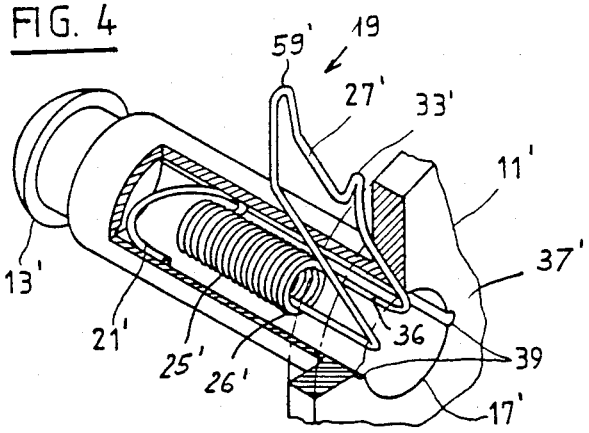

DEVICE FOR BRAKING THE LIMBS OF NEEDLE THREADS IN OSCILLATING HOOK TYPE SEWING MACHINES

BACKGROUND OF THE INVENTION

The present invention relates to oscillating hook type sewing machines, and more particularly to improvements in sewing machines wherein the shuttle hook oscillates in a substantially vertical plane.

Oscillating hook type sewing machines exhibit the advantage that the needle thread loop is not twisted during training around the hook and bobbin case and that the thread can readily pass between the hook and the shuttle driver finger, as a result of mere reversal in the direction of movement of the hook and driver finger, without any specially designed auxiliary equipment. As a rule, such types of hooks are not sensitive to changes in the tension of the thread and can assist in the making of eye-pleasing uniform stitches.

Friction between the limbs of the loop which is formed by needle thread often entails the making of slack stitches. This can take place in all kinds of sewing machines including those employing heretofore known oscillating type hooks. The magnitude of friction between the limbs of a loop depends on a plurality of parameters including the diameters and types of threads, the type of stitching, the length of loops, the width of stitches, the speed of the sewing machine and others. The just discussed friction can result in the making of non-uniform stitches.

For example, the loop which is formed by the needle thread in an oscillating hook type sewing machine must completely surround the hook, the bobbin case and the supply of bobbin thread in the case. The loop is cast off shortly or immediately before the hook changes the direction of its movement, and the thus released loop is lifted by the takeup lever so that its bight is moved against the underside of the work. As a rule, upward movement of the takeup lever entails an upward movement of the front limb of the needle thread loop, i.e., of that limb which extends through the eye of the needle. The rear limb is more or less passive. That portion of the bobbin thread which extends from the bobbin case to the underside of the work passes between the two limbs of the loop which is formed by the needle thread and normally does not interfere with a predictable reduction of the size of the needle thread loop. However, when the machine is set to make long and/or wide stitches, the needle penetrates behind that portion of the bobbin thread which extends from the bobbin case to the work during transition from a right downward stroke to a left downward stroke. Consequently, the needle thread is looped around the bobbin thread subsequent to castoff from the hook which entails the development of additional friction in the region of the front limb of the needle thread loop. This, in turn, entails a more rapid upward movement of the rear limb of the needle thread loop. The just described mode of operation does not appreciably affect the quality and/or appearance of the stitches when the sewing machine is operated at a medium speed or at an elevated speed because the making of stitches takes place at frequent intervals and the inertia of the rear limb is too pronounced so that it cannot react to the development of additional friction with the front limb. However, the situation is different when the sewing machine is operated at less than average speed or at a low speed. At such time, the upper and lower threads are in longer-lasting frictional engagement with each other because the speed at which the size of the needle thread loop is reduced is relatively low and the interval of frictional engagement between the two slowly moving threads is much longer. In other words, that component of static friction which causes the two threads to adhere to each other is more pronounced than the component of sliding friction. The upward movement of the rear limb of the needle thread loop is too rapid with the result that the entire needle thread is not drawn all the way into the work and the work is formed with so-called slack or loose stitches. Since the making of slack stitches takes place at random, they greatly affect the appearance of the product.

Attempts to avoid the making of slack stitches in other types of sewing machines include the utilization of retainers of the type disclosed in U.S. Pat. No. 4,095,539 which describes and shows a sewing machine with a rotary shuttle. This patent proposes to use a so-called work limb retainer which engages the loop during the normal loop taker cycle and discharges the thread after the thread has completed its passage around the loop taker. A somewhat similar proposal is described in German Utility Model No. 70 16 286.

The incorporation of features which lessen or eliminate the aforediscussed problems in rotary shuttle type sewing machines into an oscillating shuttle hook type sewing machine is impossible because of the entirely different nature and mode of operation of shuttles in such machines.

German Offenlegungsschrift No. 33 42 770 discloses an oscillating hook type sewing machine wherein the shuttle hook driver carries a device for braking the rear limb of the needle thread loop. A drawback of this proposal is that the braking device is complex, expensive and bulky. Moreover, the nature of the braking device which is disclosed in the Offenlegungsschrift is such that each of a short or long series of braking devices produces a different braking force so that the braking action must be individually adjusted in each and every sewing machine which employs the proposed braking device. This contributes significantly to the initial and maintenance cost of the sewing machine.

OBJECTS AND SUMMARY OF THE INVENTION

An object of the invention is to provide a novel and improved needle thread braking device for use in sewing machines with hooks which are mounted for oscillatory movement in a substantially vertical plane.

Another object of the invention is to provide a braking device which can be assembled with and supported by hooks whose configuration need not appreciably depart from the configuration of presently used oscillating hooks.

A further object of the invention is to provide a sewing machine which embodies the above outlined braking device.

An additional object of the invention is to provide a simple, inexpensible and lightweight braking device which can stand long periods of use without any or with a minimum of maintenance.

Still another object of the invention is to prevent the making of slack stitches in an oscillating hook type sewing machine irrespective of whether the machine is operated at a normal or at a reduced speed.

A further object of the invention is to provide a novel and improved hook for use in conjunction with the above outlined braking device.

Another object of the invention is to provide novel and improved means for retarding the upward movement of one limb of each of a succession of loops which are formed by the needle thread in an oscillating hook type sewing machine.

An additional object of the invention is to provide a braking device which does not affect the appearance and/or other characteristics of stitches at any selected speed of the sewing machine.

Another object of the invention is to provide a braking device whose braking force remains at least substantially unchanged during the making of millions of stitches.

The invention is embodied in a sewing machine which comprises a substantially vertically reciprocable needle for the upper thread, a needle bar or analogous means for reciprocating the needle, a shuttle hook which is mounted for oscillatory movement in a substantially vertical plane about a predetermined axis, and means for oscillating the hook so that the hook and the needle cooperate in converting the upper thread into a series of loops each of which has several limbs. In accordance with a feature of the invention, the sewing machine of the above outlined type further comprises means for temporarily braking at least one limb of each loop. The braking means includes a loop-engaging member which is movable by successive loops with reference to the hook in a second plane that is at least substantially parallel to the vertical plane from a first or starting position to a second position in which the loop-engaging member casts off the loop as a result of upward movement of the engaged portion of the loop. The braking means further comprises means for yieldably biasing the loop-engaging member to its first position.

The hook includes a substantially disc-shaped or sector-shaped end portion which is disposed in the vertical plane, and the loop-engaging member is adjacent to such end portion of the hook. In accordance with a presently preferred embodiment of the invention, the biasing means is mounted on and shares the oscillatory movements of the hook.

The braking means can further comprise a loop catcher (e.g., in the form of a substantially tooth-shaped protuberance) which is movable with the loop-engaging member relative to the hook to transfer successive loops from the hook into the path of movement of the loop-engaging member while the latter moves from or while the latter still dwells in its first position. The loop-engaging member is or can constitute an elongated part which is integral with the loop catcher. For example, the loop-engaging member can include a substantially pallet- or tooth-shaped first end portion which engages successive loops during successive movements of the member from the first to the second position, at least during the last stage of each such movement, and a second end portion which is connected to (e.g., integral with) the biasing means. The loop catcher can be provided on such elongated loop-engaging member intermediate the two end portions.

The biasing means can comprise a torsion spring one end convolution of which is integral with a leg of the loop-engaging member. In such types of sewing machines, the loop-engaging member and the torsion spring can consist of a single piece of steel wire. Alternatively, the braking means can comprise means for securing a separately machined, extruded, molded or otherwise formed loop-engaging member to the torsion spring or other suitable biasing means. For example, the hook can comprise an integral or separately produced hollow mandrel and the spring can be anchored in the mandrel. To this end, the spring can be provided with a substantially U-shaped terminal portion which is remote from the loop-engaging member and is non-rotatably mounted in the mandrel. The hook can be provided with a post which extends substantially diametrically through the hollow mandrel, and the U-shaped portion of the spring can constitute an eyelet which is partially or completely convoluted around the post in the interior of the mandrel to thus ensure that the spring is compelled to share the oscillatory movements of the hook. Alternatively, the mandrel can be formed with two internal grooves which are at least substantially parallel to the axis of the hook, and the U-shaped or otherwise configurated terminal portion of the spring has parts which extend into such grooves to ensure that the spring oscillates with the mandrel and hence with the hook.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a perspective view of a shuttle hook and of a braking device which embodies one form of the present invention, a portion of the mandrel of the hook being broken away;

FIG. 3 is an enlarged view of a portion of the structure which is shown in FIG. 2;

FIG. 4 is a similar fragmentary perspective view of a slightly modified hook and a perspective view of a slightly modified braking device;

DESCRIPTION OF THE PREFERRED EMBODIMENTS

Figure 1:
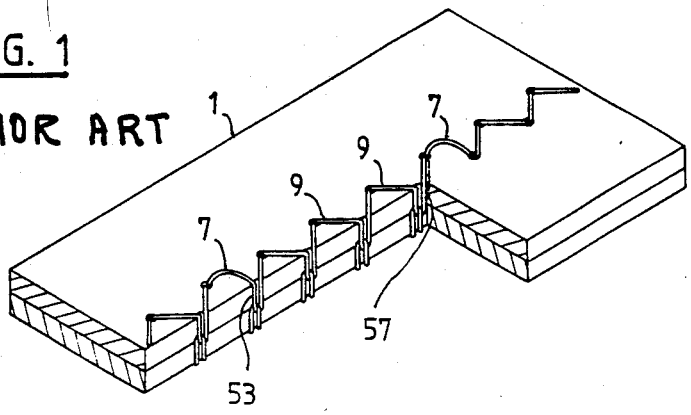
FIG. 1 PRIOR ART
FIG. 1 is a diagrammatic perspective view of a piece of work which is provided with stitching including slack loops whose formation can be avoided in accordance with the present invention.

FIG. 1 shows a piece of work 1 to be sewn and a row of stitches 7 which connect two superimposed panels of the work (e.g., a garment having two overlapping sheets of textile material). It will be seen that certain loops (denoted by the characters 9) of the upper or needle thread 53 are slack, i.e., the entire stitching is uneven which detracts from the appearance as well as from the reliability of the stitching. The slack of loops 9 is attributable to excessive length of the rear limbs 57 of these loops.

FIG. 2 shows a shuttle hook 11 which is mounted for oscillatory movement in a substantially vertical plane at a level below the support for the work so that it turns back and forth about a substantially horizontal axis A. The hook 11 comprises a coaxial hollow mandrel 13 which is surrounded by the case 15 (shown by phantom lines in FIG. 5) for a bobbin containing a supply of lower or bobbin thread. The axial bore or passage 17 of the mandrel 13 contains a portion of a novel and improved braking device 19 (see particularly FIG. 3) which includes a loop-engaging member 27 extending from the open end of the bore 17 and being located in a substantially vertical plane adjacent to the vertical plane of a substantially sector-shaped end portion or wall 37 of the hook 11. The braking device 19 further includes a torsion spring 25 which is confined in the bore 17, and more specifically in the interior of the hollow mandrel 13. The braking device 19 which is shown in FIGS. 2 and 3 consists of a single piece of metallic or other suitable wire, and the torsion spring 25 includes a substantially U-shaped terminal portion 21 which is convoluted around the intermediate portion of a post or stud 23. The latter extends diametrically of the mandrel 13 and ensures that the spring 25 is compelled to share the oscillatory movements of the hook 11 and its mandrel 13. The common axis of the convolutions of the spring 25 preferably coincides with the axis A of the hook 11. That convolution of the spring 25 which is remotest from the U-shaped terminal portion 21 is integral with one leg (35) of the loop-engaging member 27. The other leg (34) of the member 27 extends into the interior of the torsion spring 25.

The member 27 is elongated and one (59) of its end portions is bent slightly toward the free end of the mandrel and in a clockwise direction (as viewed in FIG. 3) out of the general plane of the member 27 and toward the inner (unexposed) side or surface of the end wall 37 of the hook 11. The other end portion of the member 27 includes the legs 34, 35, and an intermediate portion of the member 27 constitutes a tooth-shaped loop catcher 33 which also extends from the exposed side toward and beyond the inner side of the end wall 37 and is disposed radially inwardly of the end portion 59. The end portion 59 and the loop catcher 33 are movable relative to the end wall 37 of the hook 11 in a vertical plane which is parallel to the plane of the inner side of the end wall 37, and such movements of the parts 33, 59 take place under the action of the torsion spring 25 or under the action of a loop which is formed by the needle thread 53.

FIG. 3 shows that the entire torsion spring 25 is or can be confined in that portion of the bore 17 which extends into the mandrel 13. The U-shaped terminal portion 21 engages the intermediate portion of the post 23, and the rightmost convolution 26 of the spring 25 is integral with the aforementioned leg 35. The leg 35 extends from the bore 17 at the exposed side of the end wall 37 and has a 90-degree bend to extend substantially radially outwardly and to merge into the tooth-shaped loop catcher 33. The section 31 between the loop catcher 33 and the end portion 59 is or can be substantially straight and extends substantially radially of the hook 11. The section 29 between the end portion 59 and the leg 34 also extends substantially radially of the hook 11 and merges into the leg 34 which latter extends into the bore 17 and into the interior of the torsion spring 25. Those portions of the legs 34, 35 which are located in the bore 17 are or can be at least substantially parallel to the axis A. The end portion 59 is a loop which makes an angle of approximately 180 degrees so that the sections 29 and 31 of the loop-engaging member 27 are or can be substantially parallel to each other at the inner side of the end wall 37. The loop catcher 33 can be located substantially midway between the end portion 59 and the nearest portion of the bore 17 in the hook 11.

Figure 5:
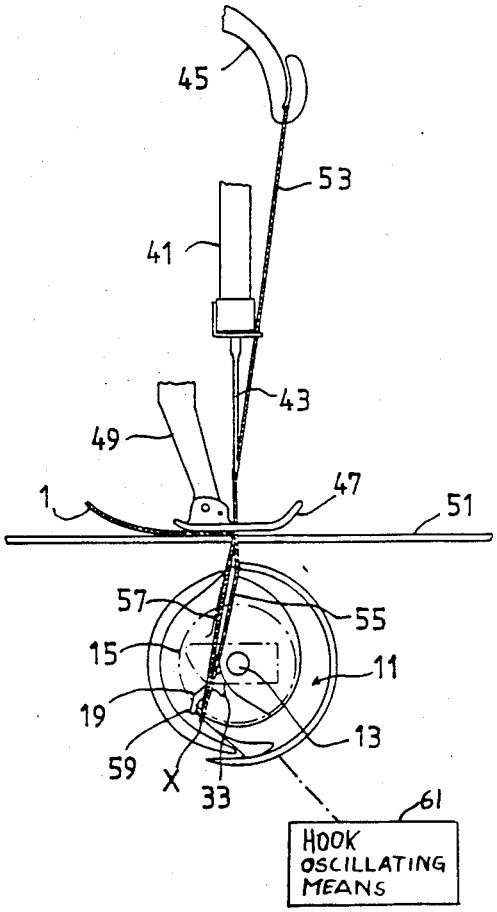
FIG. 5 is a fragmentary schematic elevational view of a portion of a sewing machine which embodies the structure of FIGS. 2 and 3, showing the loop-engaging member of the braking device in its starting position.
Figure 7:
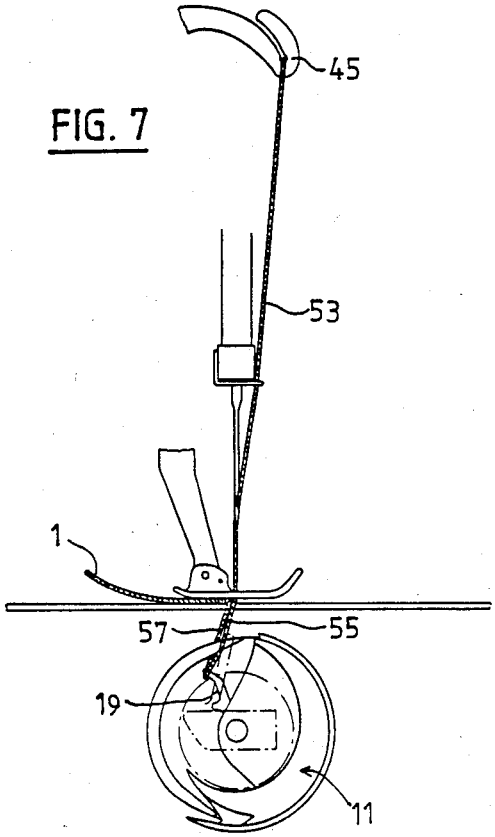
FIG. 7 illustrates the structure of FIGS. 5 and 6, with the loop-engaging member shown in the second position at the time of castoff of the needle thread loop.

The loops of the needle thread 53 can move the end portion 59 (and hence the entire loop-engaging member 27) relative to the hook 11 in the aforementioned vertical plane (next to the inner side of the end wall 37) against the opposition of the torsion spring 25 from a first position which is shown in FIG. 5 toward and to a second position which is shown in FIG. 7. The loops of the needle thread 53 engage with the end portion 59 until the latter completes a predetermined angle relative to the hook 11 (e.g., an angle of approximately 105 degrees and in a clockwise direction, as viewed in FIG. 5) so that the loop is cast off the member 27 in response to upward movement of a takeup lever 45. The spring 25 stores energy during angular movement of the loop-engaging member 27 from the first position of FIG. 5 to the second position of FIG. 7 so that it can abruptly return the member 27 to the first position of FIG. 5 as soon as the loop is cast off, i.e., as soon as the end portion 59 is disengaged from the needle thread 53.

The loop catcher 33 preferably extends, at least in part, into the customary recess 12 of the hook 11.

FIG. 4 shows a portion of a somewhat modified shuttle hook 11' and a somewhat modified braking device 19'. This braking device includes a torsion spring 25' having an enlarged substantially U-shaped terminal portion 21'parts of which extend into two axially parallel grooves 39 which are machined into or otherwise formed in the internal surface of the mandrel 13' and extend all the way to the exposed side of the end wall 37'. The terminal portion 21' in the bore 17' cooperates with the mandrel 13' to ensure that at least the major portion of the spring 25' is compelled to share the oscillatory movements of the hook 11'. The configuration of the loop-engaging member 27' of the braking device 19' is or can be identical with that of the member 27 which is shown in FIGS. 2 and 3.

Other types of means for non-rotatably anchoring the torsion spring 25 or 25' in the mandrel 13 or 13' of the shuttle hook can be used with equal or similar advantage. Furthermore, the loop-engaging member 27 or 27' can be produced as a discrete part which is thereupon secured to the spring. This is shown schematically in FIG. 4 wherein the means for securing the member 27' to the front or outer end convolution 26' of the spring 25' comprises a butt weld 36 or a spot where the discrete part is bonded to the spring with a suitable adhesive (such as a cyanide glue). Still further, the member 27 or 27' can be replaced with a stamping of sheet metal or a suitably shaped piece of synthetic plastic material, as long as it can perform the loop-catching and loop-engaging or retaining functions of the parts 33 and 59 or 33' and 59'. The spring 25 or 25', or an analogous spring, serves to reliably ensure return movement of the loop-engaging member back to its first or starting position before the hook 11 or 11' is ready to be relieved of the next needle thread loop.

Figure 6:
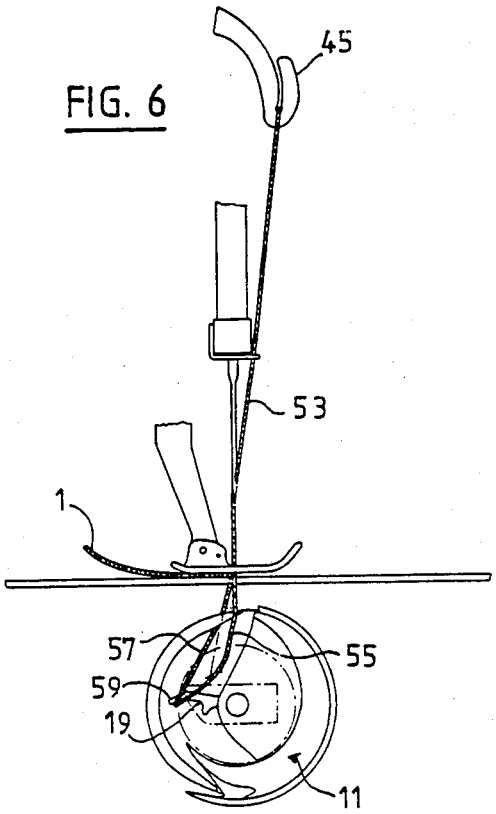
FIG. 6 shows the structure of FIG. 5 but with the loop-engaging member in an intermediate position.

FIG. 5 to 7 illustrate certain additional components of the sewing machine which embodies the structure of FIGS. 2–3 or FIG. 4. The work 1 rests on and is movable relative to a support in the form of a horizontal platform 51 which is disposed at a level above the hook 11. The means for reciprocating the needle 43 comprises a needle bar 41, and the means for oscillating the hook 11, so that its end wall 37 turns back and forth in a substantially vertical plane, is shown schematically at 61 because its construction forms no part of the present invention. The work 1 is engaged by a conventional presser foot including a sole plate 47 and a shank 49. The upper or needle thread 53 is trained over the suitably configurated lower end portion of the takeup lever 45 and passes through the eye of the needle 43.

Figure 8:
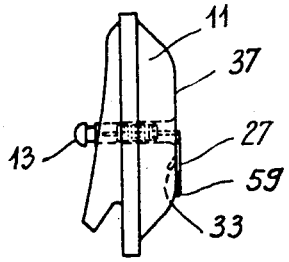
FIG. 8 is an elevational view of the hook as seen from the left-hand side of FIG. 5, 6 or 7.

When the hook 11 completes the training of the needle thread 53 around the case 15 of the bobbin for the lower or bobbin thread (not shown), the thread 53 forms a loop which includes a front limb 55 and a rear limb 57. The limbs 55 and 57 of the needle thread loop contact the end wall 37. The reference character X denotes in FIG. 5 the location where the hook 11 releases the freshly formed needle thread loop including the limbs 55, 57 whereupon the takeup lever 45 begins to lift the loop in a well-known manner so that the loop ultimately lies flat against the underside of the work 1. Shortly prior to castoff of the loop, the limb 57 slides off the end wall 37 and over the loop catcher 33 on its way toward the end portion 59. The latter is bent in such a way (as shown in FIGS. 2, 4 and 8) that it can intercept the loop and can oppose a shortening of such loop under the action of the rising takeup lever 45. Thus, the end portion 59 engages with the loop between its limbs 55 and 57. The rising takeup lever 45 moves from the lower level of FIG. 5 to the higher level of FIG. 6 and thereby causes the member 27 to turn relative to the end wall 37 (in a clockwise direction, as viewed in FIG. 5) so that the spring 25 stores energy. Such deformation of the spring 25 causes the member 27 to maintain the limb 57 of the rising needle thread loop in tensioned condition.

The lever 45 continues to move upwardly and beyond the level of FIG. 6 to the level of FIG. 7 so that the extent of angular movement of the end portion 59 from the location X of FIG. 5 increases and the needle thread loop is ultimately cast off after the member 27 completes an angular movement of approximately 105 degrees with reference to the end wall 37 of the hook 11. At such time, the dimensions of the loop at a level below the support 51 and the work 1 thereon are reduced to a fraction of the dimensions of the loop which is shown in FIG. 5. The spring 25 is then free to abruptly dissipate energy and to return the member 27 to the position of FIG. 5 so that the member 27 is ready to engage its end portion 59 with the next needle thread loop.

The terminal portion 21 or 21' or a differently configurated terminal portion of the spring 25 or 25' can be anchored in a plastic pin which, in turn, is anchored against rotation in the deepmost portion of the bore 17 or 17' of the mandrel 13 or 13'.

An important advantage of the improved braking device is that it ensures the making of satisfactory stitches irrespective of the frequency of oscillatory movement of the hook. Moreover, the entire braking device is simple, inexpensive and can be readily installed in existing sewing machines which employ oscillatory shuttle hooks. The braking action of the improved device remains unchanged for extended intervals and, if necessary, the entire braking device can be removed from the hook in a simple and time-saving operation. The sewing machine can be furnished with two or more discrete braking devices each having a spring which can oppose the angular movements of the respective loop-engaging member with a different force. It has been found that the utilization of the improved braking device in a sewing machine with an oscillating hook greatly reduces the likelihood of making of slack stitches.

The loop catcher 33 constitutes an optional but desirable feature of the improved braking device because it ensures reliable engagement between successive loops of the needle thread and the end portion 59 or 59' of the selected loop-engaging member.

Tests with the improved braking device have shown that a torsion spring can stand several million angular movements of the respective loop-engaging member between its first and second positions prior to development of initial stages of fatigue of the material of the spring.

A braking device which is made of a single piece of wire exhibits the important advantage that its mass and inertia (and particularly the mass and inertia of the loop-engaging member) are negligible so that the spring can return the loop-engaging member to the starting position in good time for engagement with the next loop irrespective of the selected speed of the sewing machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A sewing machine comprising a substantially vertically reciprocable needle for the upper thread; means for reciprocating said needle; a shuttle hook mounted for oscillatory movement in a substantially vertical plane about a predetermined axis; means for oscillating said hook so that the hook and the needle cooperate in converting the upper thread into a series of loops each having a plurality of limbs; and means for temporarily braking at least one limb of each loop, including a loop-engaging member movable by successive loops with reference to said hook in a second plane which is at least substantially parallel to said vertical plane from a first position to a second position in which a loop is cast off said member as a result of upward movement of the engaged portion of the loop; and means for yieldably biasing said member to said first position.

2. The machine of claim 1, wherein said hook includes an end portion which is located in said vertical plane and said member is adjacent to said end portion.

3. The machine of claim 1, wherein said biasing means is mounted on and shares the oscillatory movements of said hook.

4. The machine of claim 3, wherein said braking means further comprises a loop catcher movable with said member relative to said hook to transfer successive loops from said hook into the path of movement of said member from said first position.

5. The machine of claim 4, wherein said member is elongated and is integral with said loop catcher.

6. The machine of claim 5, wherein said member includes a substantially pallet-shaped first end portion which engages successive loops, at least during the last stage of each movement of said member to said second position, and a second end portion connected with said biasing means, said loop catcher being provided on said member intermediate said end portions thereof.

7. The machine of claim 1, wherein said biasing means comprises a torsion spring.

8. The machine of claim 7, wherein said torsion spring includes an end convolution and said member includes a leg which is integral with said end convolution.

9. The machine of claim 7, wherein said spring and said member consist of a single piece of wire.

10. The machine of claim 7, further comprising means for securing said member to said spring.

11. The machine of claim 7, wherein said hook comprises a hollow mandrel and said spring is anchored in said mandrel.

12. The machine of claim 11, wherein said spring comprises a substantially U-shaped terminal portion which is non-rotatably mounted in said mandrel.

13. The machine of claim 12, wherein said mandrel has two internal grooves which are substantially parallel to the axis of said hook and receive parts of said U-shaped terminal portion.

14. The machine of claim 11, wherein said hook comprises a post in said mandrel and said spring has a portion which is convoluted around said post to ensure that the spring shares the oscillatory movements of said hook.

15. The machine of claim 14, wherein said post is disposed substantially diametrically of said mandrel.

16. The machine of claim 1, wherein at least a portion of said member is resilient.

17. The machine of claim 1, wherein said hook includes a hollow section and at least a portion of said braking means is installed in said section.

* * * * *